US011674324B2

(12) United States Patent
Romero

(10) Patent No.: US 11,674,324 B2
(45) Date of Patent: Jun. 13, 2023

(54) MULTI-FUNCTION BUILDING

(71) Applicant: Luna House Ventures Inc., Miami, FL (US)

(72) Inventor: Jose Romero, Miami, FL (US)

(73) Assignee: LUNA HOUSE VENTURES INC., Miami, FL (US)

( * ) Notice: Subject to any disclaimer, the term of this patent is extended or adjusted under 35 U.S.C. 154(b) by 266 days.

(21) Appl. No.: 17/089,595

(22) Filed: Nov. 4, 2020

(65) Prior Publication Data

US 2021/0140185 A1 May 13, 2021

Related U.S. Application Data

(60) Provisional application No. 62/933,705, filed on Nov. 11, 2019.

(51) Int. Cl.

| | |
|---|---|
| ***E04H 1/02*** | (2006.01) |
| ***E04H 1/00*** | (2006.01) |
| ***E04H 1/04*** | (2006.01) |

(52) U.S. Cl.

CPC ..... *E04H 1/02* (2013.01); *E04H 1/00* (2013.01); *E04H 1/04* (2013.01)

(58) Field of Classification Search

None

See application file for complete search history.

(56) References Cited

U.S. PATENT DOCUMENTS

| | | | | |
|---|---|---|---|---|
| 3,874,137 | A | 4/1975 | Gentry | |
| 4,274,233 | A | 6/1981 | Currier | |
| 4,345,407 | A | 8/1982 | Fishman | |
| 4,345,408 | A | 8/1982 | Cote | |
| 4,685,260 | A * | 8/1987 | Jenn | E04H 1/02 D25/17 |
| 4,794,747 | A | 1/1989 | Yendo | |
| 4,942,706 | A | 7/1990 | Todd et al. | |
| 5,694,725 | A | 1/1997 | Kaufman et al. | |
| 5,806,260 | A | 9/1998 | Quaintance | |
| 5,941,034 | A | 8/1999 | Frankfurt | |
| 6,141,924 | A | 11/2000 | Quaintance | |
| 6,182,408 | B1 * | 2/2001 | Poehler | E04H 1/02 52/234 |
| 6,393,774 | B1 | 5/2002 | Fisher | |
| 6,574,931 | B2 | 6/2003 | Duany | |
| 6,698,147 | B2 | 3/2004 | Bergman | |
| 7,036,276 | B1 | 5/2006 | Apel | |

(Continued)

FOREIGN PATENT DOCUMENTS

GB 2531819 A * 5/2016 ..... B60P 3/34

*Primary Examiner* — Joshua K Ihezie

(74) *Attorney, Agent, or Firm* — Cislo & Thomas, LLP

(57) ABSTRACT

A multi-unit residential building having a perimeter residential units along the perimeter of the building, and a common area with occupiable spaces that are generally centrally located to the residential units creating two parallel corridors between the residential units and the common area for easy and efficient access to the common areas by residents of the residential units. The common area provides typical amenities and rooms normally found inside a private residential unit. A reservation system can be used to coordinate efficient use of the common areas. Non-residents can rent out the common areas with proceeds used to offset building costs to lower costs for the residents.

2 Claims, 5 Drawing Sheets

(56) References Cited

U.S. PATENT DOCUMENTS

| | | | | |
|---|---|---|---|---|
| 7,320,200 | B1 | 1/2008 | Eisner | |
| 7,497,055 | B2 | 3/2009 | Stewart et al. | |
| 7,676,998 | B2 | 3/2010 | Lessard | |
| 7,779,585 | B2 * | 8/2010 | Hester, Jr. | E04H 1/04 52/234 |
| 7,779,586 | B2 | 8/2010 | Stewart et al. | |
| 7,937,898 | B2 | 5/2011 | Quaranta | |
| 8,033,067 | B2 | 10/2011 | Miller | |
| 8,745,940 | B1 | 6/2014 | Jimenez | |
| 8,839,568 | B2 * | 9/2014 | Molander | E04H 3/08 52/79.5 |
| 9,493,940 | B2 * | 11/2016 | Collins | E04B 1/34807 |
| 9,556,632 | B2 * | 1/2017 | Malakauskas | E04B 1/34838 |
| 9,771,731 | B2 | 9/2017 | Canavati | |
| 10,000,940 | B2 | 6/2018 | McLoughlin et al. | |
| 10,287,782 | B2 | 5/2019 | Krokfors et al. | |
| 10,287,789 | B2 | 5/2019 | McLoughlin et al. | |
| 10,801,222 | B2 * | 10/2020 | Nelson | E04H 3/10 |
| 11,195,241 | B2 * | 12/2021 | Comey | G06Q 50/16 |
| 2005/0252100 | A1 * | 11/2005 | Nord | E04H 1/02 52/79.4 |
| 2013/0067832 | A1 * | 3/2013 | Collins | E04C 2/00 52/125.1 |
| 2018/0276774 | A1 * | 9/2018 | Comey | E04H 1/06 |
| 2021/0140185 | A1 * | 5/2021 | Romero | E04H 1/04 |
| 2021/0238874 | A1 * | 8/2021 | Ellis | E04H 3/10 |

* cited by examiner

MULTI-FUNCTION BUILDING

TECHNICAL FIELD

This invention relates to a design of a building with an efficient use of space by providing shared spaces for rooms and amenities typically used privately by residents, and a system that offsets building costs to help keep costs affordable for residents while providing a host of features.

BACKGROUND

Housing is typically the largest expense in an individual's budget. Housing can be quite expensive to purchase, while renting a living space does not provide an individual the opportunity to build equity in the property. Further, yearly rent increases are common, causing an individual to pay more money per year for the same size space. Thus, there has developed a large need for shared living spaces. Shared living spaces, also referred to as co-living, allow individuals to utilize common areas, which can lower overall housing costs. However, current co-living structures do not employ large common areas where shared spaces and other amenities may be assigned to or reserved by individual tenants, such as kitchens, entertainment rooms, living rooms, office spaces, and the like. In typical co-living situations, the main living spaces, namely the kitchen, living room, and dining room are located in one location and shared typically by 3 or 4 rooms. This arrangement leads to a lack of privacy that may be unwanted by many residents. These 3 or 4 rooms typically comprise a unit and are connected to other units via a hallway that only serves to provide access to the rooms and no other functional daily use.

For the foregoing reasons there is a need for a new multi-resident building that allows for shared spaces to reduce costs, but also implement a system to maintain an efficient and organized usage of the shared spaces.

SUMMARY

The present application is for a multi-unit building that maximizes the efficiency of building space and amenities while minimizing construction and maintenance costs. The technical features of the building structure allow tenants to have the benefits of a private bedroom with the cost savings of shared spaces and amenities. The present disclosure demonstrates a configuration for a floor of a building. Although presented as only a single floor, it is an object of the disclosure that a building may comprise multiple floors that are in accordance with the present disclosure. Further, it is within the scope of the disclosure that a building may include one or more floors that are in accordance with this disclosure, as well as other floor plans that differ from this disclosure.

The invention of the present disclosure overcomes the inherent flaws of current living structures by providing a building comprising a number of residential units on a perimeter of the building and a common area predominantly located interior to the residential units, the common area comprising a number of occupiable spaces, such as kitchens, large living rooms, small living rooms, dining rooms, conference rooms, office spaces, and the like. This design reduces underutilized hallways, decreases overall wall length and construction costs while offering more occupiable spaces and additional privacy to residents. Additional details of the present invention are discussed below and displayed in the attached illustrations.

The occupiable spaces may share common walls with one another, or may share common walls with other spaces of the common area, such as kitchen spaces or a dining area or may share common walls with the residential units. The use of common walls between occupiable spaces and the reduction of underutilized hallway space reduces the cost of construction, when compared to including such occupiable spaces in each individual residential unit and the hallways required to access them.

In some embodiments, the common area comprises a rectangular layout. However, the layout of the common area can be circular in shape or any other configuration known in the art.

DETAILED DESCRIPTION OF THE INVENTION

Figure 1:
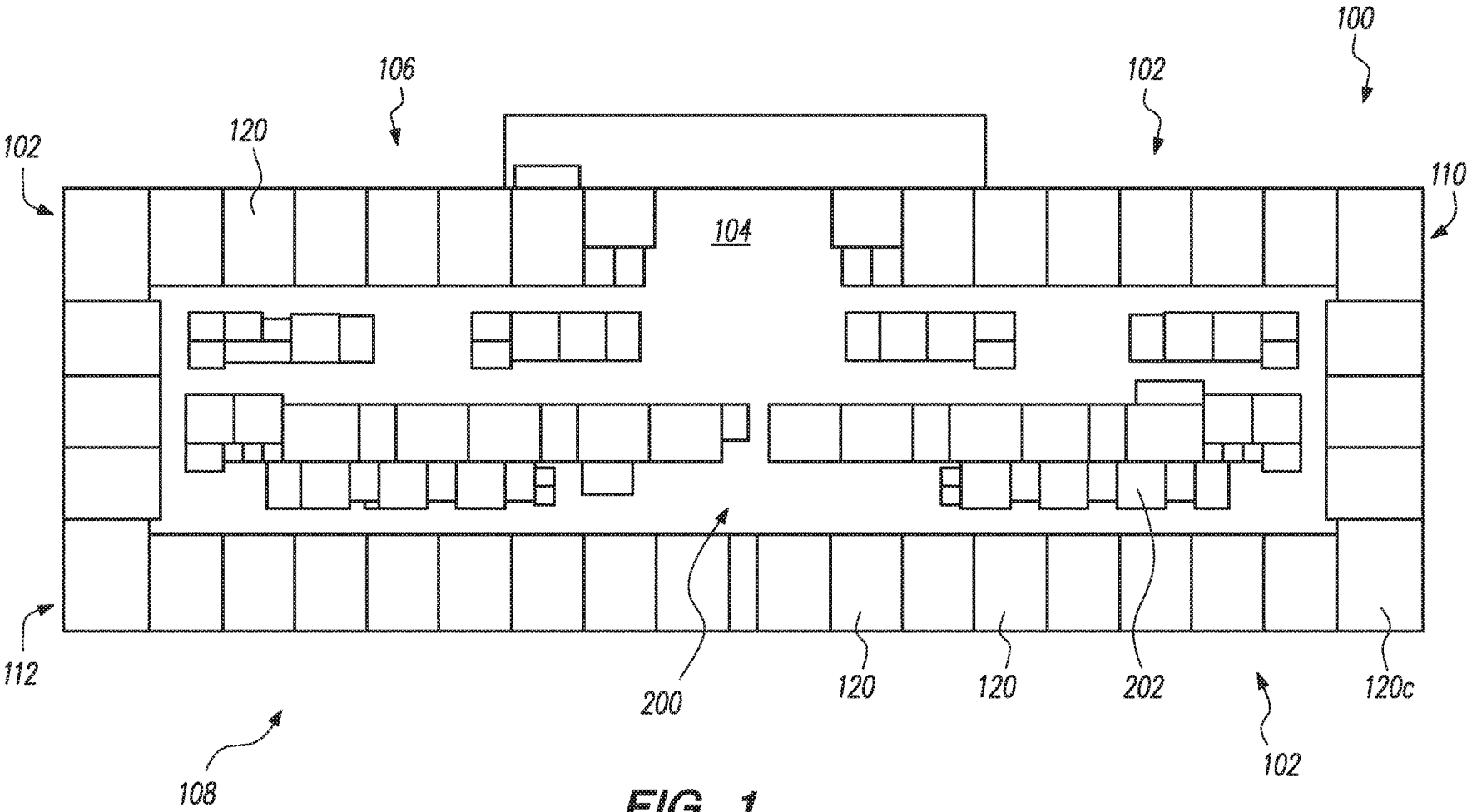
FIG. 1 shows a schematic floor plan view of an embodiment of the present invention.
Figure 2:
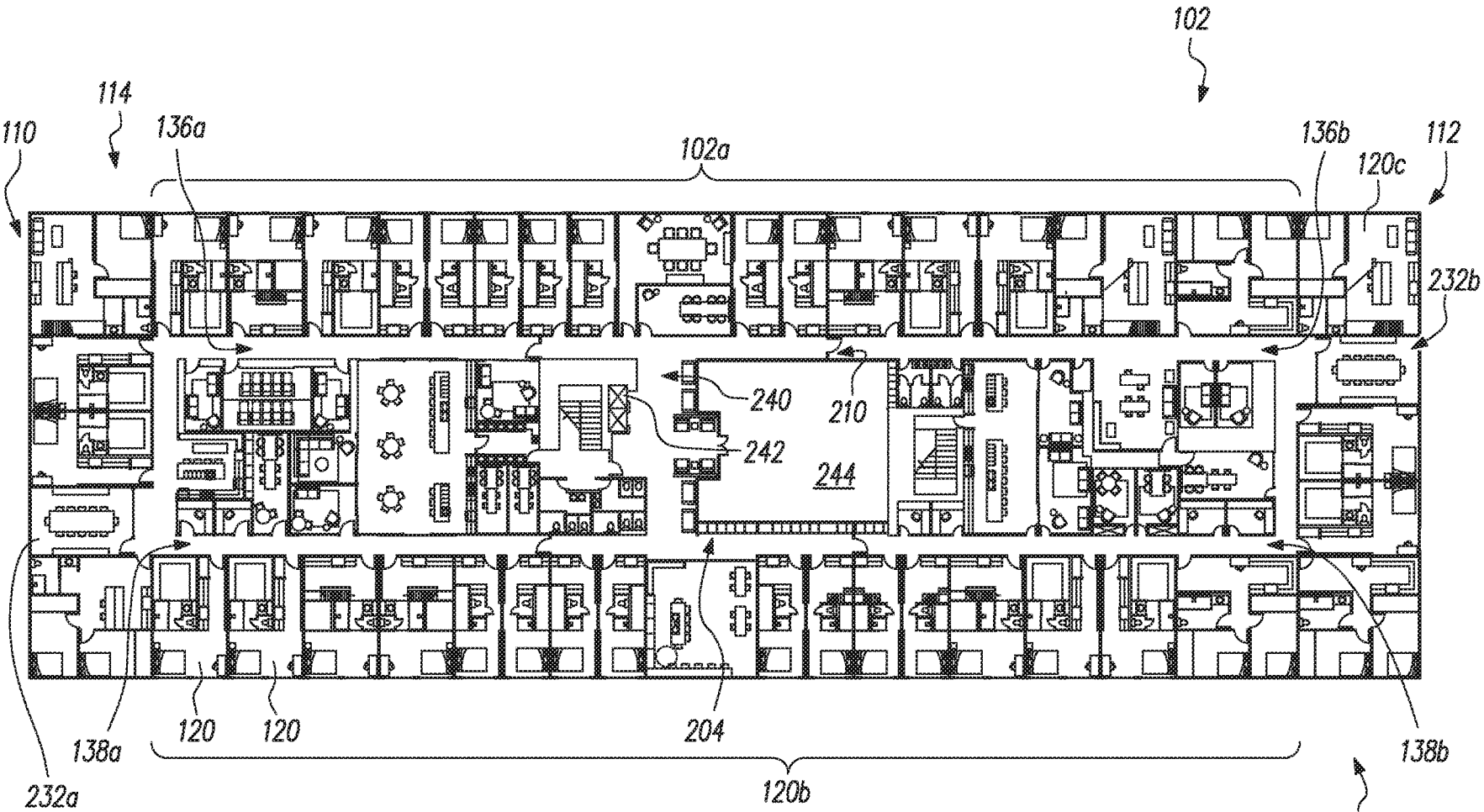
FIG. 2 shows a floor plan view of another embodiment of the present invention with additional amenities shown.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

In addition, in the context of this application, ordinal numbers, such as first, second, third, etc. are used for convenient and efficient nomenclature to distinguish one of a plurality of conceptually similar features. For example, a first floor merely distinguishes one floor from another floor, rather than limiting the first floor in time or position relative to a second floor that is directly above or below the first floor. Similarly, reference to a first floor is not limited to the ground floor or the first floor in a series of sequential floors.

With reference to FIGS. 1-5, the invention of the present application is directed towards a multi-unit residential building 100 having a perimeter 102 that economizes the use of space, reduces energy consumption, and decreases overall costs by providing a plurality of residential units 120 along the perimeter 102 of the building 100, and a common area 200 comprised of occupiable spaces 202 and, in some embodiments, storage spaces 204, that are generally centrally located to the residential units 120, wherein the common area 200 provides typical amenities and rooms normally found inside a private residential unit.

A residential unit 120 is a unit in which a resident (or tenant, which is used here interchangeably) of the building 100 resides, and therefore, the resident owns or otherwise has control over the residential unit 120. The common area 200 is an area of the building 100 that is not owned or otherwise under the control of any one resident. As such, any resident can access the common area 200 without permission from any other resident, although some restrictions may apply as discussed herein.

The invention of the present application also provides a reservation system for using and reserving the occupiable spaces 202 in the common area 200 to maintain efficient and effective use of the common area 200, and to reduce the overall cost of the building 100 compared to a comparable building in which the amenities and occupiable spaces 202 were moved into each residential unit 120. The reservation system can further offset the cost of the building 100 by charging residents and non-residents a fee for reserving a room or item.

The building 100 of the present invention comprises a perimeter 102 defining a first side 106, a second side 108 opposite the first side 106, a first end 110 adjacent to the first side 106 and the second side 108, and a second end 112 opposite the first end 110 and adjacent to the first side 106 and the second side 108. The sides 106, 108 and ends 110, 112 of the building 100 are in reference to general areas of the building 100 and are not intended to limit the shape of the building 100 to a specific shape. Therefore, the building 100 can be in the shape of a triangle, rectangle (including square), pentagon, hexagon, octagon, circle, oval, and the like.

The building 100 can be comprised of one or more floors. The floors can be residential floors 104 or non-residential floors. The residential floors 104 are comprised of residential units 120 and common areas 200. The non-residential floors can contain rooms or offices generally used in administration, maintenance, upkeep, car garage, and the like.

The residential floor 104 is bound by the perimeter 102 or exterior of the building 100. In the preferred embodiment, a set of residential units 120 can be located on the residential floor 104 along the perimeter 100 of the building structure 100. In the preferred embodiment, the set of residential units 120 comprises a first series of residential units 120*a* on a first side 106 of the building 100, and a second series of residential units 120*b* on a second side 108 of the building 100 opposite the first series of residential units 120*a*. In some embodiments, each series of residential units 120*a*, 120*b* can have a plurality of corner residential units 120*c*.

Figure 3:
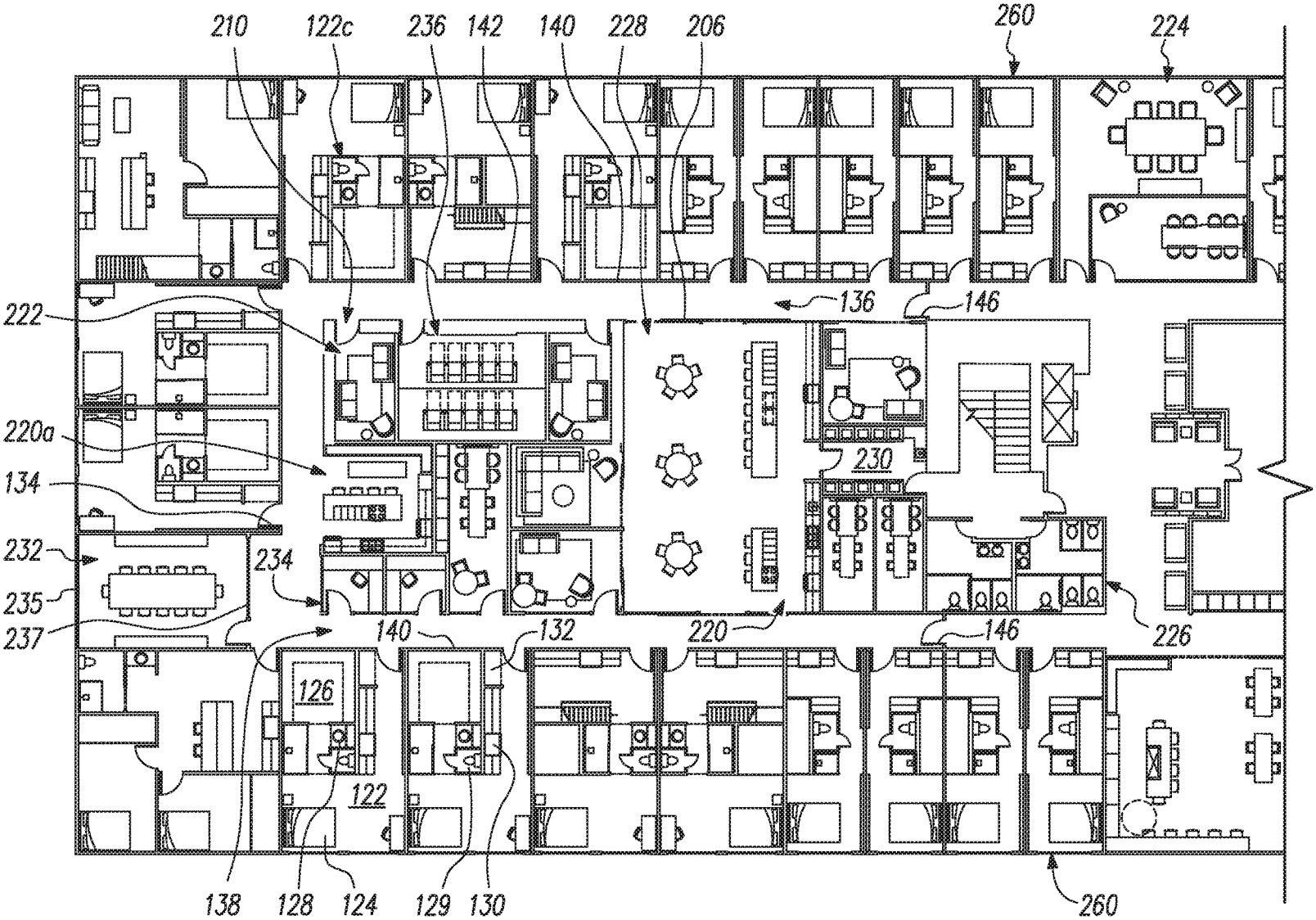
FIG. 3 shows a floor plan view of one wing of the embodiment shown in FIG. 2.
Figure 4:
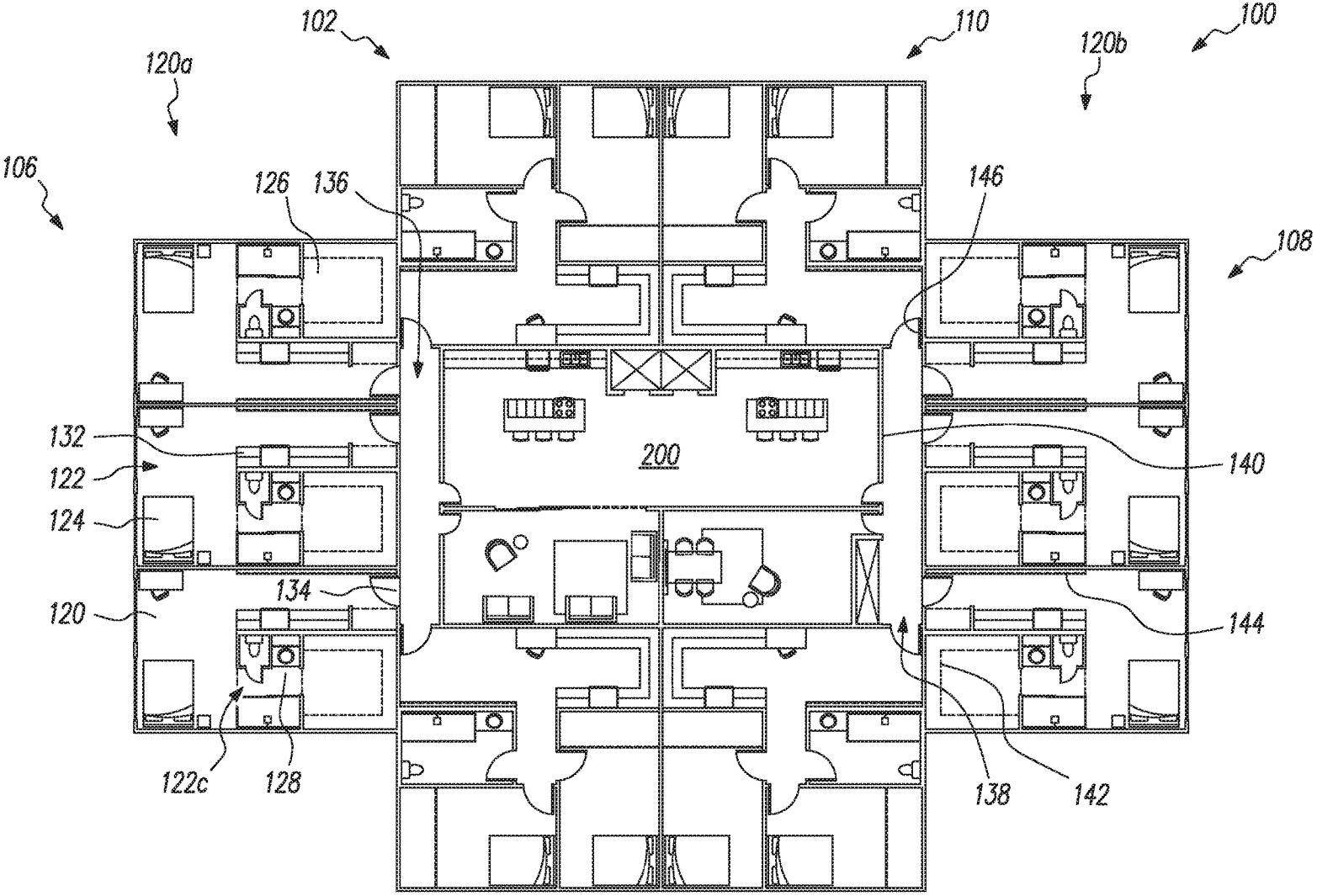
FIG. 4 shows a floor plan view of another embodiment of the present invention.
Figure 5:
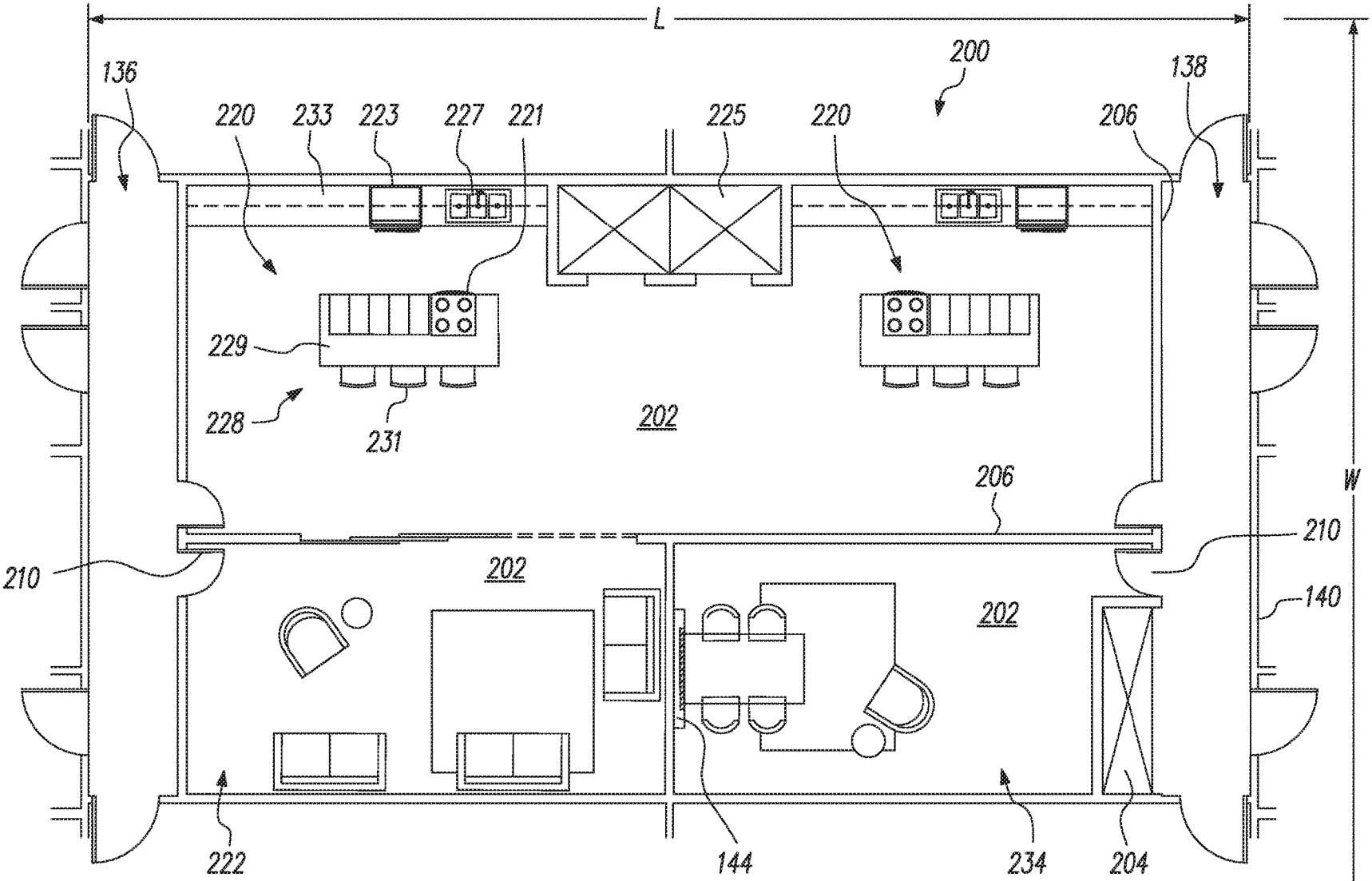
FIG. 5 shows a close up floor plan view of the common area shown in FIG. 4.

As best seen in FIGS. 3 and 4, the residential units 120 may comprise at least one room 122. In some embodiments, the residential unit 120 may comprise two or more rooms 122. In some embodiments, one room 122 can be a bedroom, comprising a bed 124, a second room can be a closet 126, a third room can be a private bathroom comprising a sink 128 and a toilet 129, a fourth room can comprise a refrigerator 130 and a cabinet 132. In some embodiments, a majority, but not necessarily all, residential units 120 comprise a private bathroom. Each residential unit 120 can have a door 134 opening into the common area 200. In some embodiments of the invention, some residential units 120 can have additional entrances opening to an exterior of the building 100 or to a stairwell.

In some embodiments, the residential units 120 can run along the entire perimeter 102 of the building 100. In some embodiments, the residential units 120 can run along a majority of the perimeter 102 of the building 100 except for one side or face of the building 100 that may feature no residential units. In some embodiments, the residential floor 104 can have at least 60 percent of the perimeter 102 of the building 100 comprising residential units 120. Stairs, balconies, or community bathrooms can also be located on the perimeter 102 of the building 100, either in between two residential units 120 or on a face or side of the building 100 where no residential units are located. In some embodiments, the perimeter 102 of the building 100 is substantially comprised of residential units 120, whereby each residential unit 120 is proximate at least one other residential unit 120 on each opposing side. In some embodiments, a preferred range of 10 percent to about 40 percent of the perimeter is not comprised of residential units 120. This absence of residential units 120 along the perimeter 102 may provide for common areas 200, elevators, windows, stairs, fire exits, balconies, balcony entrances, patios, or other features common to a floor of a building 100 to be inserted in between two residential units 120 or on a face or side of the building where no residential units 120 are located.

The efficiency of the building 100 of the present invention is the ease with which the residents can access the common area 200. Each residential unit 120 can comprise a door 134 configured to access the common area 200 from the respective residential unit 120. Because the residential units 120 face the common area 200, there can be a concern for excess noise in the residential units 120 from the common area 200. To reduce noise entering into the residential units 120 from the common area 200 or from adjoining residential units 120, sound buffers can be used. For example, the corridors 136 can be defined by walls 140 of the residential units 120 on one side and walls 206 of a common area 200 on the opposite side. The wall 140 of a residential unit 120 along one side of the corridor 136 that in part defines a corridor 136 is referred to as a corridor wall 140. As such, the corridor wall 140 of one or more residential units 120 can comprise a sound buffer 142 to buffer sound carried through the corridor 136 and into the residential units 120 from the common area 200. Sound buffers can be any material or object that can absorb, deflect, or otherwise reduce the ability of sound waves to travel into another room. In some embodiments, the sound buffer 142 can be a closet 126 or a cabinet 132 attached to the corridor wall 140. Closets 126 and cabinets 132 contain items that absorb or deflect sound thereby reducing the sound that enters the residential unit 120. In some embodiments, the sound buffer 142 can be an acoustic panel 144 incorporated within the first corridor wall 140. An acoustic panel 144 may be any material specifically designed to absorb, deflect, or otherwise reduce the ability of sound waves to travel into another room, such as foam panels, open cell foam panels, dense panels, and the like. Any combination of sound buffers 142 can also be used. In some embodiments, an acoustic panel 144 can be on the wall 140 in between cabinetry and the wall 140. In addition to providing sound buffering between residential units 120 and the common area 200, sound buffering can also be incorporated between residential units 120. Other known techniques for reducing sound can also be used as a sound buffer, including the use of structural walls and sheer walls. The sound buffer 142 can cover an entire corridor wall 140 of a residential unit 120 or a portion of the corridor wall 140 of the residential unit 120. In some embodiments, walls 206 defining the occupiable space 202 or storage room 204 of the common area 200 can comprise sound buffers 142, in particular, the walls 206 that define the corridors 136. Sound buffers can also be used on or in the floors and ceilings.

The common area 200 is located on the residential floor 104 and generally interior to the set of residential units 120. The common area 200 can be a size large enough to allow for multiple occupiable spaces 202, such as multiple kitchens 220 for use by residents of the residential units 120. The common area 200 can be a climate controlled interior space providing access to the residential units 120. The common area 200 can be accessible from the exterior of the building 100 via stairs or doors. The common area 200 can also be accessible by elevators, which may be centrally located in the common area 200 or may be located at the perimeter 102 of the building 100. By way of example only, the common area 200 can be at least 20 feet wide W as measured from the door of the residential unit 120 on one side 106 of the building 100 to the door of a residential unit 120 on an opposite side 108 of the building 100. In some embodiments, the common area 200 can have a width W of at least 10 feet. In some embodiments, the length L of the common area 200 is at least 20 feet as measured from the door of the residential unit 120 on one end 110 of the building 100 to the door of a residential unit 120 on an opposite end 112 of the building 100.

In general, the common area 200 can be substantially surrounded by the set of residential units 120. Specifically, the common area 200 can be in between the first series of residential units 120*a* and the second series of residential units 120*b*. In some embodiments, an occupiable space 202 of the common area 200 can be within the perimeter 102 of the building 100. In other words, portions of the common area 200 can extend into the perimeter 102 of the building 100 among the residential units 120.

In some embodiments, the number of occupiable spaces 202 may be equal to approximately the number of residential units 120, with a single occupiable space 202 assigned to a single residential unit 120. In some embodiments, there may be certain residential units 120 that are assigned no occupiable spaces 202, and in some embodiments, there may be a residential unit 120 that is assigned two or more occupiable spaces 202, such as an office space and a living room. The occupiable space 202 may be an enclosed area within the common area 200 with walls 206 separating one occupiable space 202 from other occupiable spaces 202.

Each occupiable space 202 may comprise a lockable entrance 210, whereby only tenants that are granted authorization to use the space may enter the occupiable space 202. In some embodiments, the key to a residential unit 120 may be used as the same key to access the occupiable space 202. In some embodiments, a separate key may be used to access the occupiable space 202. In some embodiments, the occupiable space 202 may be accessed via a passcode typed in a keypad. It is within the scope of this disclosure that multiple residential units 120 may share access to the occupiable spaces 202. It is also within the scope of this disclosure that the occupiable spaces 202 may be accessed on a reservation basis, whereby access to the occupiable space 202 are assigned to tenants of the residential units 120 for use of the occupiable space 202 for a limited period of time. The period of time may range from an hour to a few weeks. In some embodiments, occupiable spaces 202 can be accessed by non-residents on a reservation basis for a fee, proceeds of which can be used to offset the cost of the building 100.

The occupiable spaces 202 may be dispersed throughout the common area 200, whereby a tenant's assigned occupiable space 202 is proximate to the tenant's residential unit 120. In some embodiments, the occupiable spaces 202 may be grouped together in one specific region of the common area 200. The occupiable spaces 202 may be of varying occupancies and layouts or may all comprise the same occupancy and/or the same layouts. Thus, although shown in the accompanying illustrations as different size occupiable spaces 202, each individual occupiable space 202 may comprise a different size and layout.

Occupiable spaces 202 are spaces that can be occupied by people or spaces in which people can otherwise dwell. By way of example only, occupiable spaces 202 include, but are not limited to kitchens 220, living rooms 222, lounging areas 224, bathrooms 226, dining areas 228, laundry rooms 230, conference rooms 232, office spaces 234, entertainment rooms 236, and the like. For example, a common area 200 can comprise two kitchens 220 and at least two additional occupiable spaces 224-236; however, the total number of occupiable spaces 202 can be based on the total number of residential units 120.

In the preferred embodiment, the arrangement of the residential unit 120 to the common area 200 results in a first corridor 136 in between the first series of residential units 120*a* and the common area 200, and a second corridor 138 in between the second series of residential units 120*b* and the common area 200. In the preferred embodiment, the first and second corridors 136, 138 are accessible via one or more secured door 146. Generally, multi-dwelling units do not have corridors in this arrangement, which is conducive for vertically stacking residential units and running plumbing. In addition, living spaces are generally geared to have windows or access to the outside.

A lobby area 240 can be provided on the residential floor 104 approximately centrally located relative to the set of residential units 120 and the common area 200. As such, the lobby area 240 can be considered part of the common area 200. The secured doors 146 to the corridors 136, 138 control access into the corridor 136, 138 from the lobby 240. As such, visitors may be able to enter the building 100 and access the lobby area 240, but they would not be able to access the residential units 120 without authorization or a key. In some embodiments, the building 100 can also be secure so as to require authorization to enter the building 100 or the residential floors 120. Elevators 242 can be provided in the lobby area 240 to access other floors. Public bathrooms 226 can also be provided so that non-resident guests and visitors in the lobby area 240 can use bathrooms 226 without entering into the residential units 120. In some embodiments, a lounging area 224 can be provided with seating, tables, entertainment, refreshments, and the like where non-resident visitors and guests can relax while they are waiting for a resident to invite them in.

Depending on the arrangement of the building 100, the lobby 240 can separate the residential floor 104 into two different wings 114, 116 with their own respective corridors 136*a, b* and 138*a, b* accessible from the lobby 240 via secured doors 146. The common area 200 in each wing 114, 116 can have the same or similar shared spaces. The common area 200 can be arranged in a variety of different layouts depending on the number of residential units 120 and occupiable spaces 202.

The number of total occupiable spaces 202 on a residential floor 104 can be dependent on the number of residential units 120 on the residential floor 104. By way of example only, the ratio of residential unit 120 to occupiable space 202 can range from fifteen residential units 120 per occupiable space 202 to one residential unit 120 to two occupiable spaces 202. In some embodiments, there can be one living room 222 for every four residential units 120. However, this ratio may range from one living room 222 per every two residential units 120 to one living room 222 for every fifteen residential units 120. In some embodiments, there can be one office space 234 for every two residential units 120. However, this ratio may range from one office space 234 per every two residential units 120 to one office space 234 for every fifteen residential units 120.

The number of kitchen spaces 220 may correspond to the number of residential units 120 in the building 100 by a predetermined ratio. In some embodiments, the ratio between the number of kitchen spaces 220 and the number of residential units 120 can be one kitchen space 220 for every six residential units 120. In some embodiments, the ratio may be as low as one kitchen space 220 for every two residential units 120 and as high as one kitchen space 220 for every fifteen residential units 120. A kitchen space 220 may feature a stove 221, an oven 223, a microwave, a dishwasher and other amenities common to a typical kitchen. In some embodiments, certain cabinets 233 in a single kitchen space 220 may be assigned to a residential unit 120, whereby the cabinet 233 may only be accessed by the tenants of that residential unit 120. Access to assigned cabinets may be limited by locks on the cabinets requiring the use of a key, keycard, passcode, and the like to open the assigned cabinet. In some embodiments, the location of the kitchen spaces 220 may be disbursed throughout the common area 200, whereby at least one kitchen space 220 shall be located a short distance from all residential units 120. In some embodiments, every residential unit 120 can be separated from a kitchen space 220 by no more than one-quarter length of the common area 200. In some embodiments, the kitchen spaces 220 may be all located in a single region of the common area 200.

In buildings 100 with a small number of residential units 120, such as 10 or fewer, a single kitchen 220 may suffice. In the preferred embodiment, a medium sized building 100 can have from 8 to 40 residential units, with a common area having from 2 to 8 kitchens. In some embodiments, the ratio of kitchen 220 to residential units 120 can be one to two. In some embodiments, the ratio of kitchen 220 to residential unit 120 can be one to fifteen. Each kitchen can be equipped with one or more of each type of kitchen appliance, such as stove tops 221, ovens 223, microwaves, refrigerators 225, sinks 227, dishwashers, and the like. The kitchens 220 can also be provided with tabletops 229 and chairs 231. By having multiples of the same types of appliances, multiple families can use the same kitchen 220 at the same time. Such an arrangement can promote community living. Cost savings arise from the fact that the number of kitchens 220 and kitchen appliances are fewer than the number of residential units 120. The kitchen 220 can also provide seating area 228 where the residents can dine. The seating area 228 can be a cafeteria style seating area with multiple tables and chairs.

To promote convenience for the residents, kitchenware, such as cups, dishes, plates, pots, pans, silverware, cookware, and the like can be provided for by the building 100. In addition, a cleaning service can be provided so that residents using the kitchen 220 do not have to clean up after themselves. Having a third-party cleaning service will avoid any accusations that one resident does not clean up after himself as well as another resident. The cost of the cleaning service can be offset or paid for completely through revenue from the reservation system the building 100 offers, such as the rental of commercial units 260.

In some embodiments, for those interested in a more private setting, the common area 200 can comprise a private kitchen 220*a* with one of each standard kitchen appliance, such that only one family can use the kitchen at one time. The private kitchen 220*a* can be placed near a conference room 232 so that the conference room 232 can be used as a private dining room.

The conference room 232 can contain a large table centrally positioned in the conference room 232 with seating for the use of tenants of the residential units 120 and their guests. The conference room 232 can hold an occupancy of up to six persons. In some embodiments, the conference room 232 can hold an occupancy of up to eight persons. In some embodiments, the conference room 232 can hold an occupancy of up to twelve persons. In some embodiments, the conference room 232 can hold an occupancy of up to 20 persons or more. Additional credenzas or buffet tables can be provided. In addition, the conference room 232 can have communication systems, such as phones, monitors, microphones, speakers, computers with Internet connection, and the like.

Preferably, the conference rooms 232 have large exterior windows 235 facing the exterior of the building 100. Large interior windows 237 can also be provided facing the interior of the building opposite the large windows facing the exterior of the building 100. This arrangement maximizes the amount of natural light that shines through the large exterior windows 235 on the exterior of the building 100 and through the large interior windows 237 facing the interior of the building 100. Preferably, these conference rooms 232 that bring natural light into the building 100 face the corridors 136, 138 so as to illuminate the corridors 136, 138 with natural light. As such, a first conference room 232*a* can be located on the residential floor 104 along the perimeter 102 at the first end 110. Similarly, a second conference room 232*b* located on the residential floor 104 along the perimeter at the second end 112. In this configuration, these conference rooms 232 can be positioned in line with the corridors 136, 138 to provide natural lighting into the corridors 136, 138. Although this room is referred to as a conference room 232, due to the large table and seating area, the conference room 232 can also be used as a dining room, in particular, a formal dining room.

In some embodiments, the ratio of conference room 232 to residential units 120 is approximately one conference room 232 for every ten residential units 120. However, the ratio may range between one conference room 232 for every four residential units 120 to one conference room 232 for every fifteen residential units 120. A conference room 232 can be substantially similar in appearance and design, other than the intended purpose of the room. In some embodiments, the conference room 232 can be disposed throughout the common area 200, whereby each residential unit 120 is near at least one conference room 232. In some embodiments, the conference rooms 232 can be disposed grouped together in one region of the common area 200.

Additional occupiable spaces 202 in the common area 200 include living rooms 222 with couches, sofas, chairs, recliners, coffee tables, and/or end tables, and the like, where people can gather and socialize; an entertainment room 236 with seating, such as stadium seating where users can watch movies and shows on a big screens or play video games; office rooms 234 where users can work or read quietly; and a laundry room 230 for users to wash their clothes or have their clothes washed using the amenity service of the building 100.

The laundry areas 230 can comprise a washer and a dryer. In some embodiments, the common area 200 comprises at least one laundry area 230 per every three residential units 120 on the residential floor 104. However, the number of laundry areas 230 per residential unit 120 can range from one laundry area 230 per every two residential units 120 to one laundry area 230 per every fifteen residential units 120. The laundry area 230 can be dispersed throughout the common area 200, whereby each residential unit 120 is near at least one laundry area 230. In some embodiments, the laundry area 230 can be grouped together in a specific region of the common area 200.

In some embodiments, the common area 200 can have a community amenity area 244 for use by all tenants of the residential units 120, or non-residents. The community amenity area 244 can comprise a gym, a yoga studio, a pool table, spa, a bar, a workshop, a ball room, a banquet hall, and the like. In some embodiments, each residential floor 104 of a single building 100 can comprise a different type of community amenity area 244. In some embodiments, a residential floor 104 can have a plurality of community amenity areas 244 of different types. The community amenity area 244 can be accessible to all tenants of the residential units 120 of the building 100, whereby any tenant may access any community amenity area 244, even if the resident resides on a different residential floor than the residential floor 120 of the tenant. In some embodiments, one or more community amenity areas 244 can be accessible from the lobby area 240 without having to enter into the corridors 136, 138. The community amenity area 244 can be used in a variety of different ways, such as for banquets, conferences, dance floor, exercise, hobbies, entertainment, and the like. The community amenity area 244 can even be rented out to non-residents. Proceeds from the reservation can be used to offset the cost of the building 100. The community amenity area 244 can have a secured door through which residents can access the community amenity area 244 without having to go through the lobby 240.

In some embodiments, the common area 200 can also comprise storage rooms 204, such as closets, utility rooms, cabinets, lockers, and the like. These storage rooms 204 can store additional amenities for residents to access. These storage rooms 204 can contain sporting equipment; entertainment material, such as videos and games; leisure material, such as books; hobby materials, such as arts and crafts, and the like. In some embodiments, storage rooms 204 can be used long term by residents to store their own personal items that may not fit inside their residential units 120. These amenities can be locked up in the storage rooms 204, and made accessible to the residents with a key, card, code, and the like. In some embodiments, residents can use the reservation system to reserve these types of items. This reservation system can help residents save costs as people tend to expend money in a particular activity only to stop engaging in such activity once the novelty has worn off. Therefore, rather than residents buying such amenities for themselves, they can simply use these amenities provided by the building. If the residents are using the storage rooms 204 long term to store their personal items, then the reservation system can be used to charge the residents.

In some embodiments, one or more of the residential units 120 on the residential floor 104 can be used as a commercial unit 260. A commercial unit 260 is a residential unit 120 that is rented out to visitors or guests to generate revenue for the building 100. As such, occupants of a commercial unit 260 would not have as strong of interest in the long-term use of the building as their occupancy may be limited to a few days, weeks, or months. As such, in the preferred embodiment, the commercial units 260 can be the units that are at least as close to or closer to the lobby area 240 than the residential units 120 occupied by the residents. By placing the commercial units 260 adjacent to the lobby area 240, entry into the commercial units 260 can be via the lobby area 240. Therefore, occupants of the commercial units 260 may not have access to the residential unit 120 without permission or authorization due to the secured doors of the corridors 136, 138.

By way of example only, each residential unit 120 can have an occupancy limit of two persons, each large living room 222 will have an occupancy limit of fifteen persons, each small living room 222 can have an occupancy limit of four persons, each office space 234 can have an occupancy limit of one person, each conference or dining room 232 can have an occupancy limit of eight persons.

Although buildings exist with shared spaces, the applicant is not aware of any buildings that exist with the extent of shared spaces as disclosed in the present application that can be used regularly at the same time. For example, condominiums, apartments, hotels, and the like may have shared laundry facilities or gym, but these facilities are not used as frequently and at regular times as a kitchen, dining room, living room, family room, or office. If the laundry machine or a gym equipment is not available, the user simply comes back at a later time. However, most people eat and work at regular times, and so finding the kitchen, dining area, living room, family room, office, and the like occupied when a resident desires to use it can be problematic. Similarly, certain common items stored in the storage rooms 204 can be used more frequently than others. Always finding this item to be used by another resident can be problematic.

To account for this issue, the building utilizes a reservation system. The reservation system is a computer-implemented system that can keep track of how often a room or item is used, when it is used, how long it is used for, and the like. By keeping track of the data, the system can establish reservation times that suits the needs of the residents and non-residents. Each resident or non-resident can have a reservation app on their smart phones, computers, tablets, and the like to see available times and make their reservations. Based on the data, there can be an open period in which no reservation is required to use a room or item. In addition, by keeping track of room or item usage data, the reservation system can determine which rooms or items are not being used and which are being over-used. With this information, items or rooms that are infrequently used can be removed, replaced, and or repurposed with items or rooms that are frequently used so as to meet the demand. The reservation system can project on demand, which rooms or items will be available at the desired time, and notify the resident. As such, the reservation system can keep rooms occupied by guests when residents are not using the rooms, and keep rooms occupied by residents when guests are unlikely to use the rooms. This method for efficiently keeping rooms in use can maximize revenue for the building 100 because guests will have to pay for occupancy, and residents may be paying for priority. As such, occupancy of rooms is maximized.

The reservation system can work on a point system. For example, each resident can be issued a certain point total based on their unit. This point total can be different for each unit and based on the location and size of the unit. The floor 104 can be split between residential units 120 and commercial units 260. Each common area 200 has an amenity cost that varies based on supply and demand and is dynamic. By keeping track of the current residents' usage and projecting their expected usage using human mobility studies, queueing theory mathematics, and statistics, the reservation system predicts resident usage to improve the probability that a room or item is available at the time and date the resident desires to use the room or item, and prioritizes residents above guests. The reservation system seeks to provide residents with occupiable spaces 202 closer to their unit when projected to be in use and holds occupiable spaces 202 even if unreserved for projected resident use expected. The goal is to provide a level of service for residents that approaches about 75% to about 99% availability in the moment and on demand for a specified date and time. Preferably, the reservation system results in about 80% to about 95% availability when a resident requests a room or item. More preferably, the reservation system results in about 85% to about 95% availability, and even up to about 90% to about 95% availability, when a resident requests a room or item for a specified dated and time. People do not like reserving spaces and fear not having the spaces available. Creating a reservation system that projects and anticipates your usage using all the data available reduces the need to book spaces in advance. The system also prioritizes guest usage for lobby access to common areas 200 to reduce guest access in more secure and more residential spaces.

Using the same system and information to project guest usage the system dynamically adjusts guest points to reflect the optimal on the margin pricing for spaces such that revenue is optimized given the constraints listed above for resident use.

Keeping track of room or item usage data, the reservation system can determine which rooms or items are not in high demand and which are in high demand relative to their operating cost. With this information, items or rooms that are not valued can be removed, replaced, or repurposed with items or rooms that are more valued so as to meet the demand of both residents and guests.

Residents can buy additional amenity points and the system is designed such that about 80% to about 90% of the residents' demands are met with existing points. The hard users can buy additional points at a reduced rate relative to guests. Residents that do not use their points in a given month are compensated with additional revenue sharing after a baseline guest usage has been reached. This incentivizes residents to use points wisely and not give them away to guests.

Amenity points can also be used to acquire room nights in the commercial spaces 260, storage spaces 204, or other products or services such as massages or drinks. Amenity points can accrue based on an action taken by the resident or for refraining from an action to which the resident was entitled. In some embodiments, amenity points can be purchased. The revenue generated from purchases of amenity points can be used to offset costs associated with the building 100. Based on queuing theory of the residents, the system predicts what occupiable space and items should be kept available for residents and guests. By way of example only, the Luna model uses the M/M/c queue also known as the Erlang C model to estimate queues for each corresponding space within the Luna Reservation system. The goal is to have the rooms available to residents when they request the room a target percentage of the time, and have it available and occupied by guests when it will not result in an unsatisfactory service uptime for residents. Since residents can only be in one place at one time the system estimates the probability of each resident using each type of space during a certain period of time. This results in an arrival rate and service rate for each type of space. The goal is to have enough spaces of each type (servers/channels) that meet a minimum level of service availability for residents for each type of space and then maximize the revenue guests pay to use the spaces for periods when guest usage would not bring the level of service below a threshold that is unsatisfactory to residents. In this way, the lowered cost of housing to residents and guests benefit from on demand usage when needed subject to availability which is determined by the reservation system based on level of service for the amenity requested.

The formulas below describe the M/M/c queue, and is a general overview of some of the formulas for this reservation system:

Probability of n spaces reserved in a system with a total of c spaces is shown by Equation 1.

$$P_n = P_o \frac{\rho^{\mu}}{n!} \text{ for } n < c \qquad \text{Equation 1}$$

$$P_n = P_o \frac{\rho^{\mu}}{c^{n-0} c!} \text{ for } n > c$$

Expected average queue length is shown by Equation 2.

$$E(m) = p_o \frac{\rho^{c+1}}{cc!} \frac{1}{(1-\rho/c)^2} \qquad \text{Equation 2}$$

where:

λ=Arrival Rate

μ=Service Rate

ρ=λ/μ

C=Number of Service Channels

M=Random Arrival/Service rate (Poisson)

D=Deterministic Service Rate (Constant rate)

Similarly, housekeepers are staffed based upon expected and actual usage of the property for specific time periods and seasonal fluctuations in demands for hotel stays and space reservations using the same queueing theory math. In the case of housekeepers the goal is to have a satisfactory level of service during each block of time while minimizing the housekeeping cost.

Traditionally hotels have housekeeping needs in the morning and have excess capacity of housekeepers in the afternoon. By including the residential uses within the system, the need throughout the day for housekeeping is stabilized, and this increases the housekeeping utilization rate and lowers the overall cost of housekeeping in the system.

In some embodiments, a resident can receive preferential treatment by applying amenity points. For example, amenity points can be used to give one resident priority over another when reserving an occupiable space 202, an item in storage 204, or reserving a commercial room 260 for a guest. Amenity points can accrue based on an action taken by the resident or for refraining from an action to which the resident was entitled. In some embodiments, amenity points can be purchased. The revenue generated from purchases of amenity points can be used to offset costs associated with the building 100.

The reservation system can take the form of an entirely hardware embodiment, an entirely software embodiment or an embodiment containing both hardware and software elements. In one embodiment, the system is implemented in software, which includes but is not limited to firmware, resident software, microcode, apps, and the like.

Furthermore, the reservation system can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium comprise a semiconductor or solid-state memory, magnetic tape, a removable computer diskette, a random access memory (RAM), a read-only memory (ROM), a rigid magnetic disk and an optical disk. Current examples of optical disks comprise compact disk-read only memory (CD-ROM), compact disk-read/write (CD-R/W) and DVD.

A data processing system suitable for storing and/or executing program code comprises at least one processor coupled directly or indirectly to memory elements through a system bus. The memory elements can include local memory employed during actual execution of the program code, bulk storage, and cache memories that provide temporary storage of at least some program code in order to reduce the number of times code is retrieved from bulk storage during execution.

Input/output or I/O devices (including but not limited to keyboards, displays, pointing devices, etc.) can be coupled to the reservation system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

Described above, aspects of the present application can be embodied in a World Wide Web ("WWW") or ("Web") site accessible via the Internet. As is well known to those skilled in the art, the term "Internet" refers to the collection of networks and routers that use the Transmission Control Protocol/Internet Protocol ("TCP/IP") to communicate with one another. The internet 20 can include a plurality of local area networks ("LANs") and a wide area network ("WAN") that are interconnected by routers. The routers are special purpose computers used to interface one LAN or WAN to another. Communication links within the LANs may be wireless, twisted wire pair, coaxial cable, or optical fiber, while communication links between networks may utilize 56 Kbps analog telephone lines, 1 Mbps digital T-1 lines, 45 Mbps T-3 lines or other communications links known to those skilled in the art.

Furthermore, computers and other related electronic devices, including tablets and cell phones, can be remotely connected to either the LANs or the WAN via a digital communications device, modem and temporary telephone, or a wireless link. It will be appreciated that the internet comprises a vast number of such interconnected networks, computers, and routers.

A remote access user may access features from the World Wide Web via a web browser program or an app installed on the user's device, such as a computer, tablet, or cell phone. Upon request from the remote access user via the web browser or app, the web browser or app requests execution of the desired command from the appropriate web server. The WWW browser may also retrieve programs from the web server, such as JAVA applets, for execution on the client device. Finally, the WWW browser may include optional software components, called plug-ins, that run specialized functionality within the browser.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A multi-unit residential building, comprising:

a) a perimeter defining a first side, a second side opposite the first side, a first end adjacent to the first side and the second side, and a second end opposite the first end and adjacent to the first side and the second side;

b) a residential floor bound by the perimeter;

c) a first set of residential units located on the residential floor along the perimeter, the first set of residential units comprising a first series of side residential units, a second series of side residential units, and a plurality of corner residential units, wherein the first set of residential units comprises at least ten residential units;

d) a first common area located on the residential floor and interior to the first set of residential units, wherein the first common area is in between the first series of residential units and the second series of residential units, the first common area being substantially surrounded by the first set of residential units and comprising at least two kitchens and at least two occupiable spaces selected from the group consisting of a living room, a bathroom, a conference room, a laundry room, a storage room, an office, and an entertainment room;

e) a first corridor in between the first series of residential units and the first common area, the first corridor accessible via a secured door;

f) a second corridor in between the second series of residential units and the first common area, the second corridor accessible via a second secured door;

g) a first conference room located on the residential floor along the perimeter at the first end;

h) a second conference room located on the residential floor along the perimeter at the second end;

i) a lobby area on the residential floor approximately centrally located relative to the first set of residential units and first common area;

j) a commercial unit on the residential floor at least as close to or closer to the lobby area than the plurality of residential units, k) wherein the commercial unit is accessible from the lobby area, l) wherein each residential unit comprises a door configured to access the first common area from the respective residential unit, m) wherein at least one side residential unit comprises a corridor wall adjacent to the first or second corridor, and a sound buffer along the first corridor wall, the sound buffer selected from the group consisting of a closet attached to the first corridor wall, a cabinet attached to the first corridor wall, and open cell foam within the first corridor wall.

2. The multi-unit residential building of claim 1, further comprising a plurality of residential floors bound by the perimeter, each residential floor comprising a respective set of residential units along the perimeter, and a respective common area surrounded by the respective set of residential units.

* * * * *